US011168565B2

(12) United States Patent
Winder et al.

(10) Patent No.: US 11,168,565 B2
(45) Date of Patent: Nov. 9, 2021

(54) HEAT SHIELD INSERT

(71) Applicant: United Technologies Corporation, Farmington, CT (US)

(72) Inventors: Calvin J. Winder, Cromwell, CT (US); Joshua C. O'Connor, Middletown, CT (US); Christopher StMary, Marlborough, CT (US); Fadi S. Maalouf, East Hampton, CT (US); Krishna Bangalore, Middletown, CT (US); Cory R. Bowersox, Meriden, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 447 days.

(21) Appl. No.: 16/114,920

(22) Filed: Aug. 28, 2018

(65) Prior Publication Data

US 2020/0072055 A1 Mar. 5, 2020

(51) Int. Cl.
*F01D 5/02* (2006.01)
*F01D 5/06* (2006.01)

(52) U.S. Cl.
CPC ..... *F01D 5/027* (2013.01); *F01D 5/066* (2013.01); *F05D 2220/32* (2013.01); *F05D 2240/15* (2013.01)

(58) Field of Classification Search
CPC . F01D 5/027; F01D 5/066; F01D 5/08; F05D 2240/15
See application file for complete search history.

(56) References Cited

U.S. PATENT DOCUMENTS

| | | | | |
|---|---|---|---|---|
| 4,669,959 | A | 6/1987 | Kalogeros | |
| 8,353,670 | B2 * | 1/2013 | Glasspoole | F01D 5/027 416/144 |
| 8,662,845 | B2 | 3/2014 | Virkler et al. | |
| 8,840,375 | B2 | 9/2014 | Virkler | |
| 8,870,544 | B2 * | 10/2014 | Caprario | F01D 5/066 416/220 R |
| 9,567,857 | B2 * | 2/2017 | Snyder | F01D 1/02 |

* cited by examiner

*Primary Examiner* — Michael L Sehn
(74) *Attorney, Agent, or Firm* — Cantor Colburn LLP

(57) ABSTRACT

An insert is disposable between an exterior surface of an annular body and an annular flange and between a support wall supportive of the annular flange and surface features of the exterior surface. The insert includes a forward section sized to fit between and to extend along respective arc-segments of the exterior surface and the annular flange and an aft section. The forward section includes a first end wall abuttable with the support wall, a second end wall and inner and outer diameter surfaces that extend between the first and second end walls for abutment with the exterior surface and the annular flange, respectively. The aft section extends from the second end wall to be engageable with the surface features.

13 Claims, 6 Drawing Sheets

HEAT SHIELD INSERT

BACKGROUND

Exemplary embodiments of the present disclosure relate generally to rotor balancing and, in one embodiment, to a heat shield insert module for rotor balancing.

A gas turbine engine typically includes a fan section, a compressor section, a combustor section and a turbine section. Air entering the compressor section is compressed and delivered into the combustion section where it is mixed with fuel and ignited to generate a high-energy exhaust gas flow. The high-energy exhaust gas flow expands through the turbine section to drive the compressor and the fan section. The compressor section typically includes low and high pressure compressors, and the turbine section includes low and high pressure turbines.

The gas turbine engine includes a plurality of rotors arranged along an axis of rotation of the gas turbine engine in both the compressor section and the turbine section. To an extent that these rotors are unbalanced, they will vibrate as they rotate about the axis of rotation. Currently, such vibration is avoided or reduced by the provision of aft hub module balance features that are disposed at or near the interface of the high pressure compressor section and the high pressure turbine section. The aft hub module balance features are provided following testing processes which indicate where additional weight needs to be added.

Once the location of each aft hub module balance feature is determined, it is secured to an exterior surface of the corresponding rotor stack and typically takes the form of a blade-lock style weight. As such, balance corrections are possible with relatively easy assembly and disassembly. The also lead to issues, however, in terms of windage generation resulting from the aft hub module balance features interacting with the local boundary layers formed by fluid flows propagating through the gas turbine engine.

BRIEF DESCRIPTION

According to an aspect of the disclosure, an insert is disposable between an exterior surface of an annular body and an annular flange and between a support wall supportive of the annular flange and surface features of the exterior surface. The insert includes a forward section sized to fit between and to extend along respective arc-segments of the exterior surface and the annular flange and an aft section. The forward section includes a first end wall abuttable with the support wall, a second end wall and inner and outer diameter surfaces that extend between the first and second end walls for abutment with the exterior surface and the annular flange, respectively. The aft section extends from the second end wall to be engageable with the surface features.

In accordance with additional or alternative embodiments, a thickness of the forward section is less than a length of the annular flange.

In accordance with additional or alternative embodiments, the inner and outer diameter surfaces have curvatures similar to those of the exterior surface and the annular flange.

In accordance with additional or alternative embodiments, the aft section is engageable with the surface features to prevent insert movement in axial and circumferential dimensions.

In accordance with additional or alternative embodiments, the aft section includes an elongate body which extends along an arc-segment of the forward section.

In accordance with additional or alternative embodiments, the forward section is formed to define one or more cutouts along the outer diameter surface.

According to another aspect of the disclosure, a weight-balanced rotor assembly of a gas turbine engine is provided and includes an annular exterior surface comprising surface features, first and second annular walls, first and second annular flanges supported on the first and second walls, respectively, an annular heat shield fittable between the first and second flanges to surround an intervening section of the exterior surface that includes the surface features and an insert. The insert includes a forward section abuttable with the first wall and sized to fit between the exterior surface and the first flange and an aft section extending from the forward section to be engageable with the surface features to axially and circumferentially lock the insert.

In accordance with additional or alternative embodiments, the exterior surface includes an interface of high pressure compressor and turbine sections of a gas turbine engine.

In accordance with additional or alternative embodiments, a forward exterior surface section smoothly and continuously extends into the first wall.

In accordance with additional or alternative embodiments, the surface features include a circumferential array of bifurcated tabs defining a circumferential array of tab grooves and a split retaining ring securable between the bifurcated tabs of the circumferential array.

In accordance with additional or alternative embodiments, the forward section includes a first end wall abuttable with the first wall, a second end wall and inner and outer diameter surfaces that extend between the first and second end walls for abutment with the exterior surface and the first flange, respectively.

In accordance with additional or alternative embodiments, a thickness of the outer diameter surface is less than a length of the first flange.

In accordance with additional or alternative embodiments, a forward edge of the heat shield is configured to fit between the first flange and a forward portion of the aft section and a first face of the heat shield is configured to face the second end wall.

In accordance with additional or alternative embodiments, the inner and outer diameter surfaces have curvatures similar to those of the exterior surface and the first flange.

In accordance with additional or alternative embodiments, the forward section is sized to extend along respective arc-segments of the exterior surface and the first flange and the aft section includes an elongate body which extends along an arc-segment of the forward section.

In accordance with additional or alternative embodiments, the insert is provided as one or more inserts each having one of two or more weights.

In accordance with additional or alternative embodiments, the forward section of each of the one or more inserts is formed to define one or more cutouts.

According to another aspect of the disclosure, a method of weight-balancing a rotor assembly of a gas turbine engine without generating windage is provided. The method includes assembling the rotor assembly to comprise an annular exterior surface comprising surface features, first and second annular walls and first and second annular flanges supported on the first and second walls, respectively, spinning the rotor assembly about a rotational axis to identify an unbalanced condition and positioning one or more inserts on the rotor assembly to correct the unbalanced condition. Each of the one or more inserts includes a forward section abuttable with the first wall and sized to fit between the exterior surface and the first flange and an aft section extending from the forward section to be engageable with the surface features to axially and circumferentially lock the insert.

In accordance with additional or alternative embodiments, the assembling further includes forming a forward exterior surface section which smoothly and continuously extends into the first wall.

In accordance with additional or alternative embodiments, each of the one or more inserts has one of two or more weights and the method further includes selecting each of the one or more inserts in accordance with the one of the two or more weights thereof.

These and other advantages and features will become more apparent from the following description taken in conjunction with the drawings.

BRIEF DESCRIPTION OF THE DRAWINGS

The following descriptions should not be considered limiting in any way. With reference to the accompanying drawings, like elements are numbered alike.

These and other advantages and features will become more apparent from the following description taken in conjunction with the drawings.

DETAILED DESCRIPTION

A detailed description of one or more embodiments of the disclosed apparatus and method are presented herein by way of exemplification and not limitation with reference to the Figures.

Figure 1:
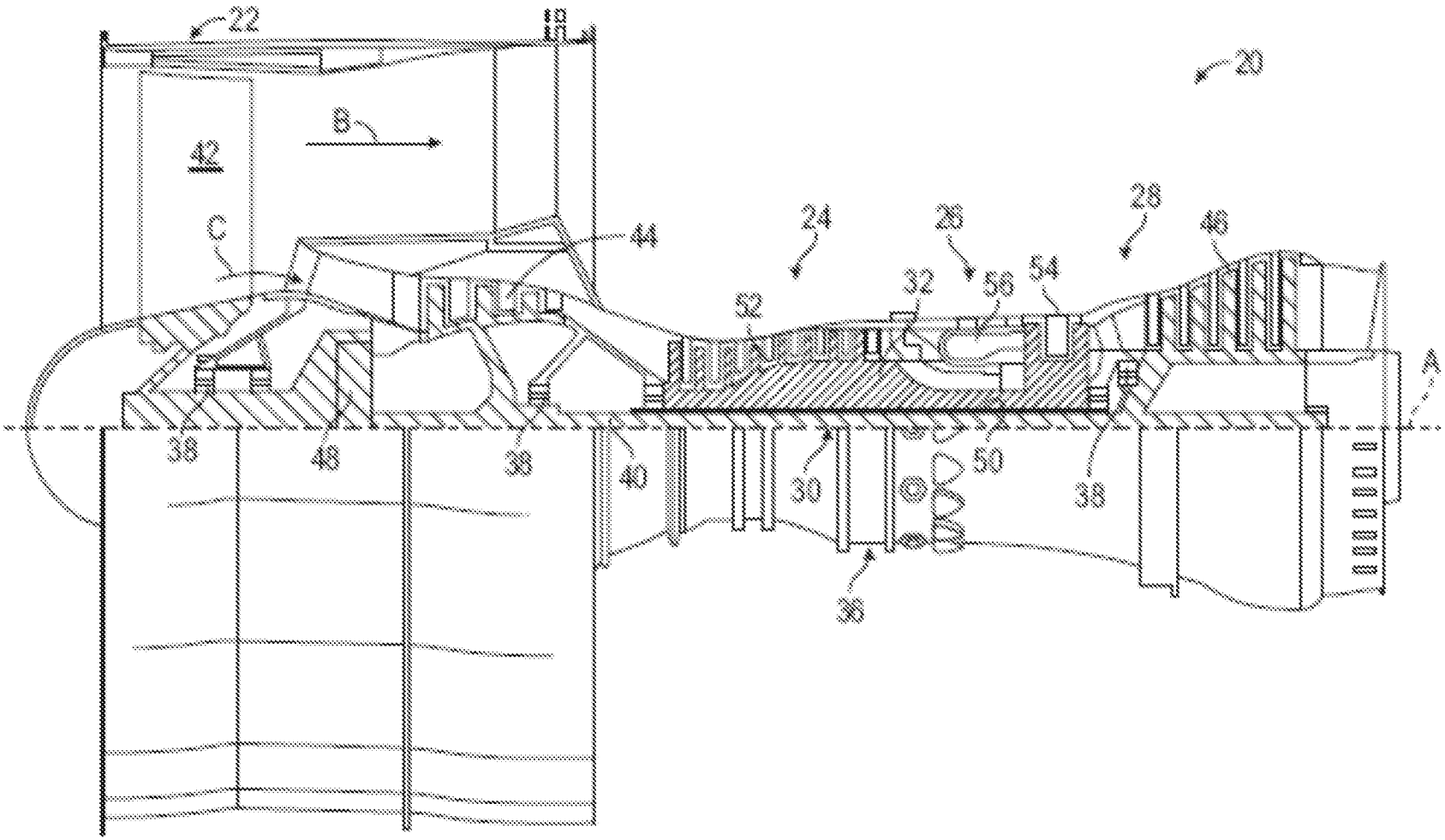
FIG. 1 is a partial cross-sectional view of a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include other systems or features. The fan section 22 drives air along a bypass flow path B in a bypass duct, while the compressor section 24 drives air along a core flow path C for compression and communication into the combustor section 26 and then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary gas turbine engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a low pressure compressor 44 and a low pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged in the gas turbine engine 20 between the high pressure compressor 52 and the high pressure turbine 54. The engine static structure 36 is arranged generally between the high pressure turbine 54 and the low pressure turbine 46. The engine static structure 36 further supports the bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 and then the high pressure compressor 52, is mixed and burned with fuel in the combustor 56 and is then expanded over the high pressure turbine 54 and the low pressure turbine 46. The high and low pressure turbines 54 and 46 rotationally drive the low speed spool 30 and the high speed spool 32, respectively, in response to the expansion. It will be appreciated that each of the positions of the fan section 22, compressor section 24, combustor section 26, turbine section 28, and fan drive gear system 48 may be varied. For example, geared architecture 48 may be located aft of the combustor section 26 or even aft of the turbine section 28, and the fan section 22 may be positioned forward or aft of the location of geared architecture 48.

The gas turbine engine 20 in one example is a high-bypass geared aircraft engine. In a further example, the gas turbine engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the gas turbine engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present disclosure is applicable to other gas turbine engines including direct drive turbofans.

A significant amount of thrust is provided by the bypass flow B due to the high bypass ratio. The fan section 22 of the gas turbine engine 20 is designed for a particular flight condition—typically cruise at about 0.8Mach and about 35,000 feet (10,688 meters). The flight condition of 0.8 Mach and 35,000 ft (10,688 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of [(Tram ° R)/(518.7° R)]0.5. The "Low corrected fan tip speed" as disclosed herein according to one non-limiting embodiment is less than about 1150 ft/second (350.5 m/sec).

Figure 2:
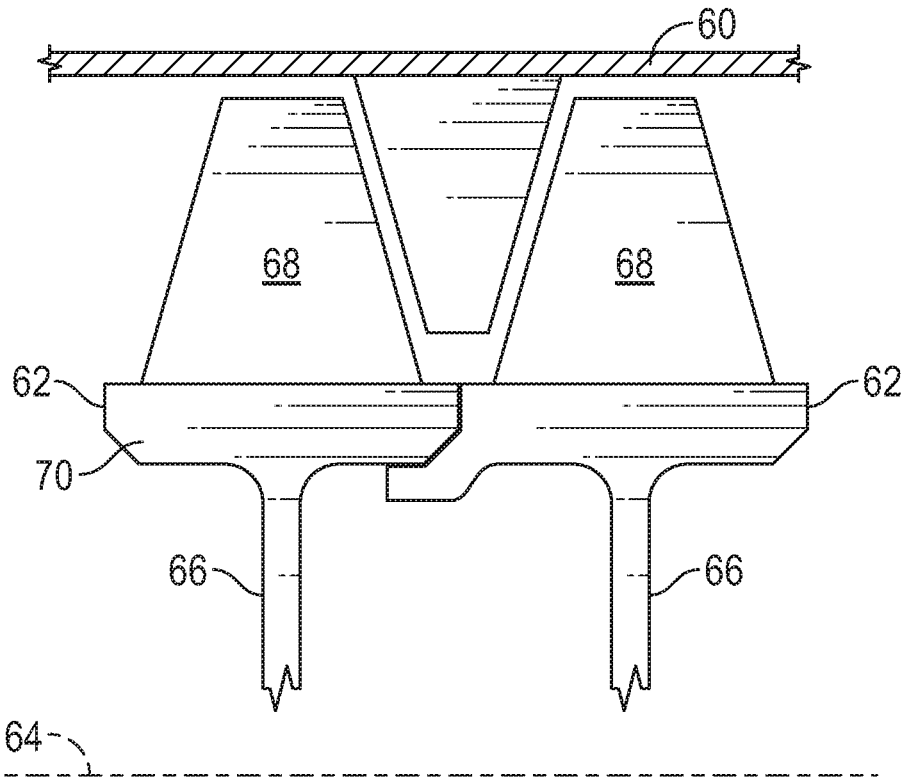
FIG. 2 is a partial cross-sectional view of an embodiment of a portion of a compressor section of the gas turbine engine of FIG. 1.

Referring now to FIG. 2, either or both of the low pressure compressor 44 or the high pressure compressor 52 includes a compressor case 60, in which compressor rotors 62 are arranged along an engine axis 64 about which the compressor rotors 62 rotate. Each compressor rotor 62 includes a rotor disc 66 with a platform 70 and a plurality of rotor blades 68 extending radially outwardly from the platform 70 (i.e., a rotor stack). In some embodiments, the rotor disc 66 and the plurality of rotor blades 68 are a single, unitary structure, an integrally bladed compressor rotor 62. In other embodiments, the rotor blades 68 are each installed to the rotor disc 66 via, for example, a dovetail joint where a tab or protrusion at the rotor blade 68 is inserted into a corresponding slot in the platform 70.

Figure 3:
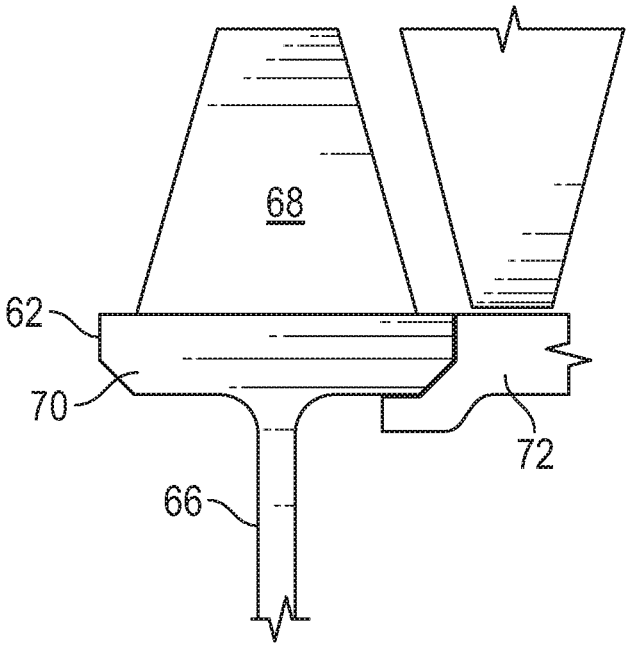
FIG. 3 is a partial cross-sectional view of another embodiment of a portion of a compressor section of the gas turbine engine of FIG. 1.

As shown in FIG. 2, axially adjacent compressor rotors 62 may be joined to each other, while in other embodiments, as shown in FIG. 3, the compressor rotor 62 may be joined to another rotating component, such as a spacer 72. The compressor rotor 62 is secured to the adjacent rotating component by an interference fit or a "snap fit," which in some embodiments is combined with another mechanical fastening, such as a plurality of bolts (not shown) to secure the components and to form or define a snap location.

Figure 4:
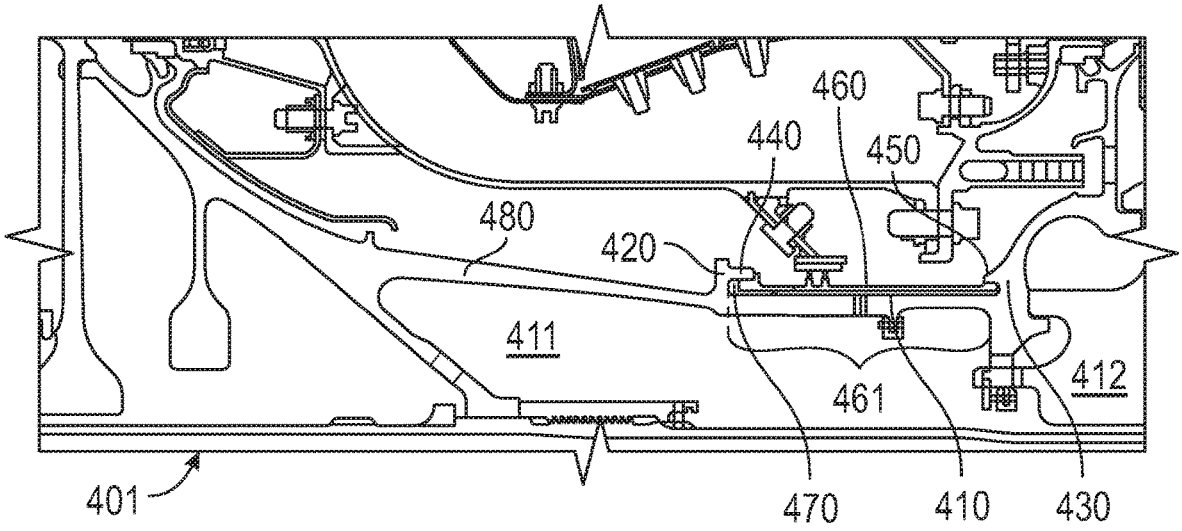
FIG. 4 is a side schematic illustration of an interface between high pressure compressor and turbine sections of a gas turbine engine in accordance with embodiments.
Figure 5:
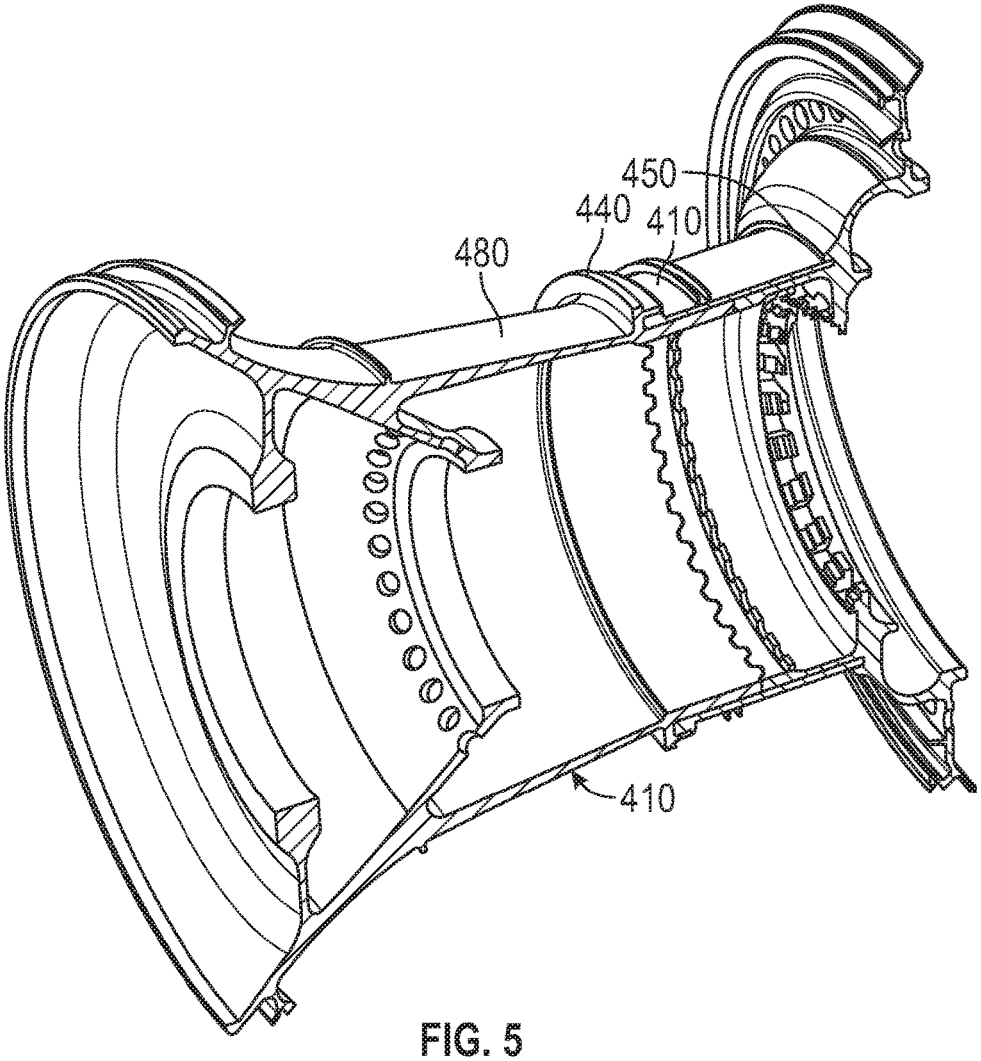
FIG. 5 is a perspective view of the interface of FIG. 4 in accordance with embodiments.

Referring now to FIGS. 4 and 5, a weight-balanced rotor assembly 401 is provided and includes an annular exterior surface 410, first and second annular walls 420 and 430, first and second annular flanges 440 and 450 supported on the first and second annular walls 420 and 430, an annular heat shield 460 and an insert 470. In some cases, the exterior surface 410 can include or be provided as an interface of high pressure compressor and turbine sections 411 and 412 of a gas turbine engine such as the gas turbine engine 20 of FIGS. 1-3. It is to be understood, however, that this is not required and that the following description is applicable to other cases and is merely presented herein as an example.

The exterior surface 410 includes surface features 413 (see FIGS. 6, 7 and 8) to be described in further detail below. The first wall 420 is located at a first axial location of the exterior surface 410 and the second wall 430 is located at a second axial position of the exterior surface 410. The first axial position may be defined at an aft section of the high pressure compressor section of a gas turbine engine and the second axial position may be defined at a forward second of the high pressure turbine section of the gas turbine engine. Thus, the second axial position may be aft of the first axial position.

As shown in FIG. 4, the weight-balanced rotor assembly 401 may also include a forward exterior surface section 480. The forward exterior surface section 480 extends with a taper towards a rotational axis A of the weight-balanced rotor assembly 401 with increasing distance in the aft direction. In addition, the forward exterior surface section 480 extends smoothly and continuously into the first wall 420. This feature is distinct from conventional rotor assemblies that include windage-generating weight-balance assemblies at locations that would normally be defined immediately forward from the first wall 420. The presence of the forward exterior surface section 480 instead of the windage-generating weight-balance assemblies of conventional rotor assemblies is made possible by the insert 470, which is configured to provide weight-balancing for the weight-balanced rotor assembly 401 without generating windage.

Figure 6:
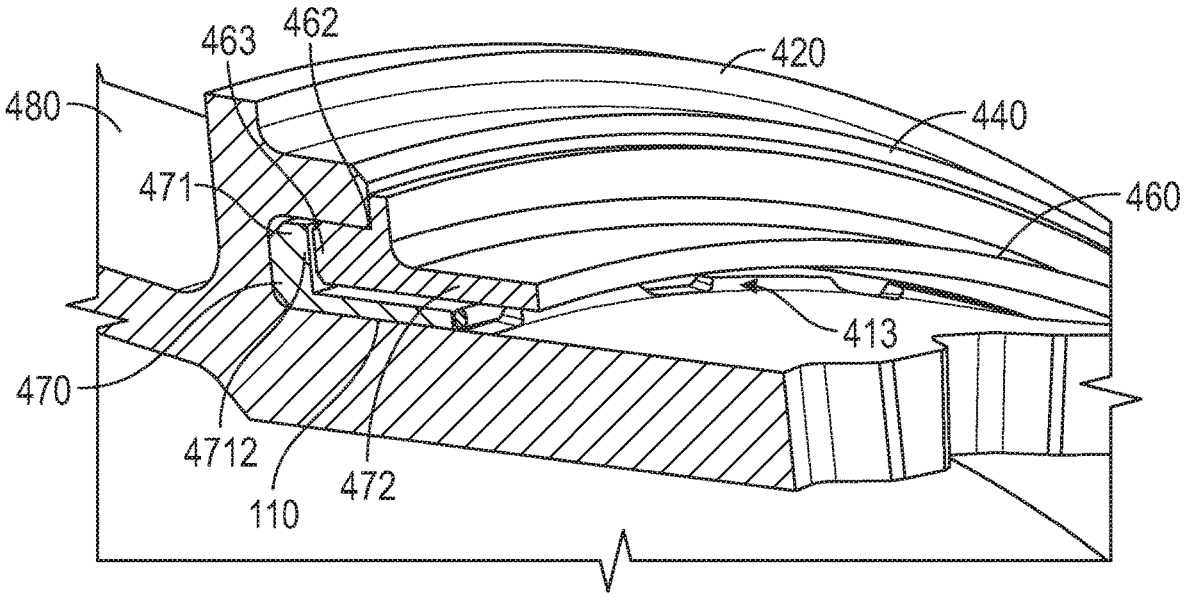
FIG. 6 is an enlarged perspective view of a portion of the interface of FIG. 4 from a different angle in accordance with embodiments.
Figure 7:
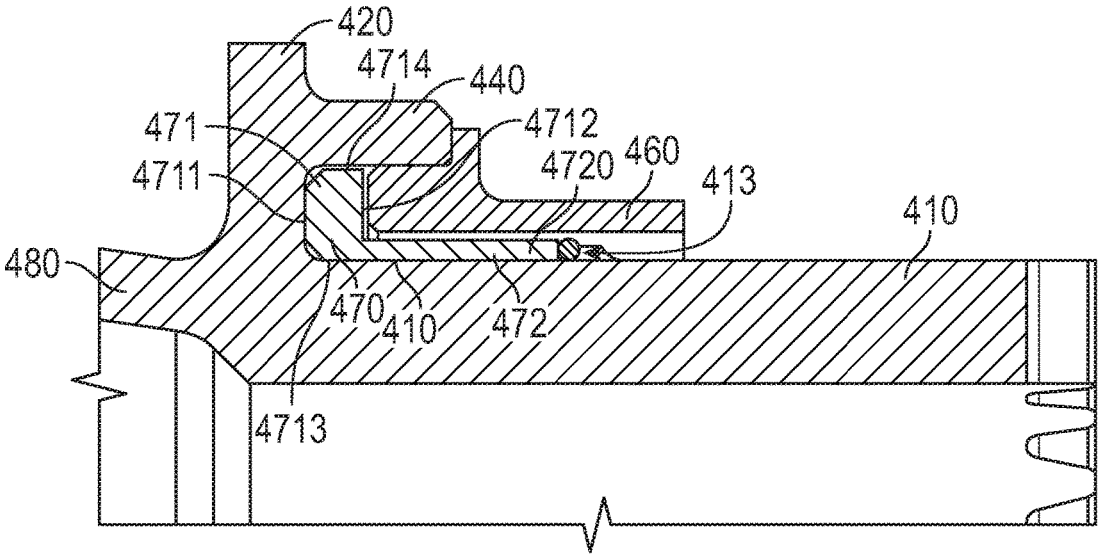
FIG. 7 is an enlarged perspective view of the portion of the interface of FIG. 6 in accordance with embodiments.
Figure 8:
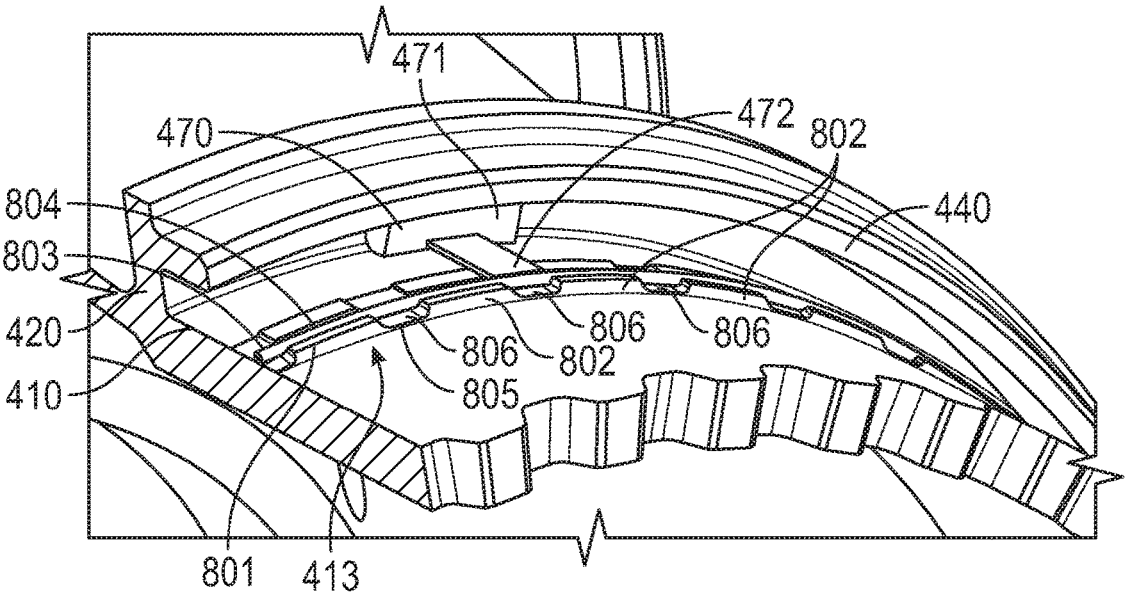
FIG. 8 is an enlarged perspective view of the portion of the interface of FIG. 6 without an intervening heat shield in accordance with embodiments.
Figure 9:
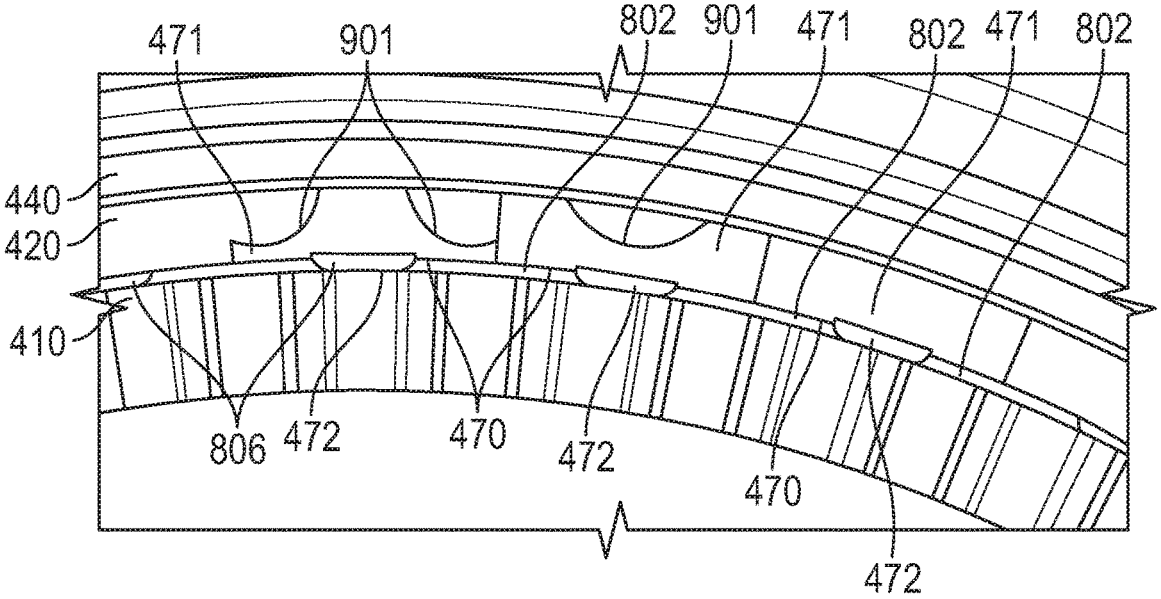
FIG. 9 is an axial view of the portion of the interface of FIG. 6 without the intervening heat shield in accordance with embodiments.

With continued reference to FIG. 4 and with additional reference to FIGS. 6 and 7 and to FIGS. 8 and 9, the annular heat shield 460 is fittable between the first and second flanges 440 and 450 to annularly surround an intervening section 461 of the exterior surface 410. This intervening section 461 includes the surface features 413.

The insert 470 includes a forward section 471 and an aft section 472. The forward section 471 is sized to fit between the exterior surface 410 and the first flange 440 and to extend along respective arc-segments of the exterior surface 410 and the first flange 440. The forward section 471 includes a first end wall 4711, a second end wall 4712, an inner diameter surface 4713 and an outer diameter surface 4714 (see FIG. 7). The first end wall 4711 faces forward in the axial dimension and is abuttable with the first wall 420. The second end wall 4712 is opposite the first end wall 4711 and faces aft in the axial dimension. The inner diameter surface 4713 extends in the axial dimension between the first and second end walls 4711 and 4712 and is configured for abutment with a corresponding arc-segment of the exterior surface 410. The outer diameter surface 4714 extends in the axial dimension between the first and second end walls 4711 and 4712 and is configured for abutment with the corresponding arc-segment of the first flange 440. The inner and outer diameter surfaces 4713 and 4714 may have curvatures which are similar to those of the exterior surface 410 and the first flange 440. The aft section 472 extends aft in the axial dimension from the second end wall 4712 to be engageable with the surface features 413 to axially and circumferentially lock the insert 470 in discrete axial and circumferential locations relative to the exterior surface 410. The aft section 472 includes an elongate body 4720 that extends along an arc-segment of the forward section 471 (see FIG. 7). That is, the aft section 472 may be thinner in the circumferential dimension than the forward section 471 (see FIG. 9).

A forward edge 462 of the heat shield 460 (see FIG. 6) is configured to register with complementary edges of the first flange 440 and to fit between the first flange 440 and a forward portion of the aft section 472 of the inert 470. A first face 463 of the heat shield 460 (see FIG. 6) is configured to face forward in the axial dimension toward the second end wall 4712. A thickness of the outer diameter surface 4714 of the forward section 471 of the insert 470 is less than a length of the first flange 440 in the axial dimension. In some cases, the first face 463 may be separated from the second end wall 4712 by an axial distance (see FIG. 7). In some additional cases, a radial height of the forward section 471 of the insert 470 may be less than the distance between the exterior surface 410 and the first flange 440 in the radial dimension by a radial distance (see FIG. 7).

As shown in FIG. 8, the surface features 413 may include a circumferential array 801 of bifurcated tabs 802 and a split retaining ring 803. Each set of bifurcated tabs 802 defines a circumferential groove 804 in which the retaining ring 803 is securably disposable. The adjacent sets of bifurcated tabs 802 cooperatively define a circumferential array 805 of tab grooves 806. The aft section 472 of the insert 470 is sized to fit in each tab groove 806 such that the insert 470 can be circumferentially located in discrete circumferential locations corresponding to the tab grooves 806.

Where an insert 470 is inserted into weight-balanced rotor assembly 401, the forward section 471 is secured in the pocket formed by the exterior surface 410, the first wall 420 and the first flange 440. In such cases, the aft section 472 is secured in one of the tab grooves 806 to circumferentially locate the insert 470 in the corresponding discrete circumferential location. In addition, the aft face of the aft face 472 engages with the retaining ring 803 such that the retaining ring 803 effectively axially locates the insert 470 in the corresponding axial location.

As shown in FIG. 9, the insert 470 may be provided in one or more configurations thereof. For example, the insert 470 may be provided as having at least two or more weights (e.g., a lowest weight insert 470, a highest weight insert 470 and a middle weight insert 470). In these or other cases, the forward section 471 of each of the one or more inserts 470 may be formed to define zero cutouts, one cutout 901 or more than one cutout 901. That is, a lowest weight insert 470 could have two cutouts 901, a highest weight insert 470 could have zero cutouts 901 and a middle weight insert 470 could have a single cutout 901.

The option of using inserts 470 of various weights allows for a customization of weight-balancing for any individual rotor assembly.

Figure 10:
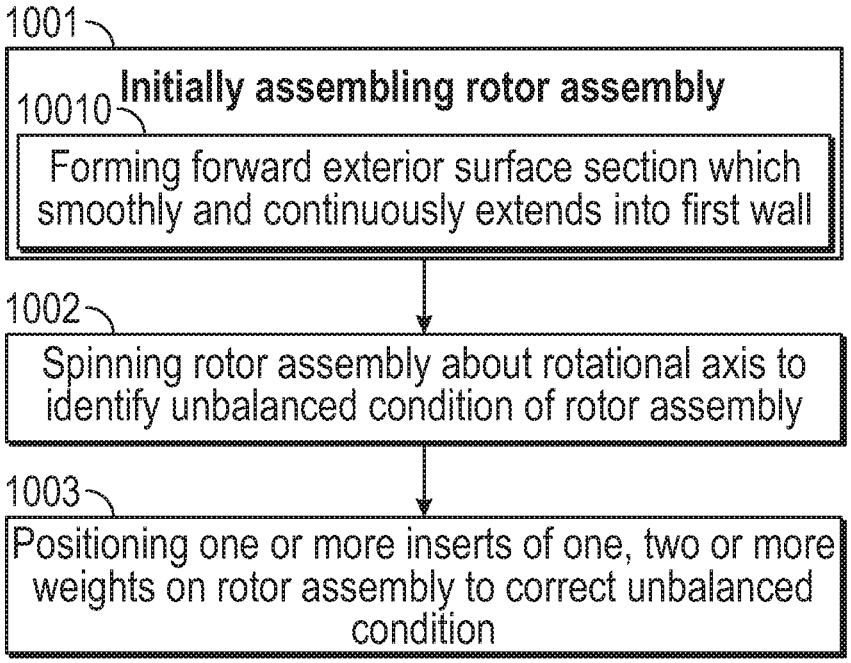
FIG. 10 is a flow diagram illustrating a method of weight-balancing a rotor assembly without generating windage in accordance with embodiments.

With reference to FIG. 10, a method of weight-balancing a rotor assembly without generating windage is provided and is applicable for use to obtain the weight-balanced rotor assembly 401 described herein. As shown in FIG. 10, the method includes initially assembling a rotor assembly to include an annular exterior surface that includes surface features, first and second annular walls and first and second annular flanges supported on the first and second walls, respectively (1001). In addition, the method can include spinning the rotor assembly about a rotational axis on a testing jig to identify an unbalanced condition of the rotor assembly (1002) and positioning one or more inserts of the one, two or more weights on the rotor assembly to correct the unbalanced condition (1003). As described above, each of the one or more inserts can include a forward section abuttable with the first wall and sized to fit between the exterior surface and the first flange and an aft section extending from the forward section to be engageable with the surface features to axially and circumferentially lock the insert. In some cases, the assembling can include forming a forward exterior surface section which smoothly and continuously extends into the first wall (10010). The spinning of the rotor assembly and the positioning of the insert can be repeated iteratively to achieve a balanced condition within a predefined threshold.

Benefits of the features described herein are the provision of a weight-balanced rotor assembly, the removal of windage concerns of other balancing features and weight savings. The weight-balancing is achieved by an insert that is positioned in such a way as to avoid the generation of windage without substantially increasing the difficulty of conducting the weight-balancing processes. The local rotor features (i.e., the aft hub) will be easier to manufacture and the insert will be easy to install and move during balancing operations. The insert will be fully contained and can be made from any material of sufficient density that can withstand local temperatures.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A weight-balanced rotor assembly of a gas turbine engine, comprising:
- an annular exterior surface comprising surface features comprising a circumferential array of bifurcated tabs defining a circumferential array of tab grooves and a split retaining ring securable between the bifurcated tabs of the circumferential array;
- first and second annular walls;
- first and second annular flanges supported on the first and second annular walls, respectively;
- an annular heat shield fittable between the first and second flanges to surround an intervening section of the exterior surface that includes the surface features; and
- an insert comprising:
  - a forward section abuttable with the first annular wall and sized to fit between the exterior surface and the first flange; and
  - an aft section extending from the forward section to fit in a corresponding one of the tab grooves of the surface features to axially and circumferentially lock the insert,
  - wherein an aft face of the aft section is engageable with the split retaining ring.

2. The weight-balanced rotor assembly according to claim 1, wherein the exterior surface comprises an interface of high pressure compressor and turbine sections of a gas turbine engine.

3. The weight-balanced rotor assembly according to claim 1, further comprising a forward exterior surface section which smoothly and continuously extends into the first annular wall.

4. The weight-balanced rotor assembly according to claim 1, wherein the forward section comprises:

a first end wall abuttable with the first annular wall;

a second end wall; and inner and outer diameter surfaces that extend between the first and second end walls for abutment with the exterior surface and the first flange, respectively.

5. The weight-balanced rotor assembly according to claim 4, wherein a thickness of the outer diameter surface is less than a length of the first flange.

6. The weight-balanced rotor assembly according to claim 5, wherein:

a forward edge of the heat shield is configured to fit between the first flange and a forward portion of the aft section, and a first face of the heat shield is configured to face the second end wall.

7. The weight-balanced rotor assembly according to claim 4, wherein the inner and outer diameter surfaces have curvatures similar to those of the exterior surface and the first flange.

8. The weight-balanced rotor assembly according to claim 1, wherein:

the forward section is sized to extend along respective arc-segments of the exterior surface and the first flange, and the aft section comprises an elongate body which extends along an arc-segment of the forward section.

9. The weight-balanced rotor assembly according to claim 1, wherein the insert is provided as one or more inserts each having one of two or more weights.

10. The weight-balanced rotor assembly according to claim 9, wherein the forward section of each of the one or more inserts is formed to define one or more cutouts.

11. A method of weight-balancing a rotor assembly of a gas turbine engine without generating windage, the method comprising:

assembling the rotor assembly to comprise an annular exterior surface comprising surface features comprising a circumferential array of bifurcated tabs defining a circumferential array of tab grooves and a split retaining ring securable between the bifurcated tabs of the circumferential array, first and second annular walls and first and second annular flanges supported on the first and second annular walls, respectively;

spinning the rotor assembly about a rotational axis to identify an unbalanced condition; and positioning one or more inserts on the rotor assembly to correct the unbalanced condition, each of the one or more inserts comprising a forward section abuttable with the first annular wall and sized to fit between the exterior surface and the first flange and an aft section extending from the forward section to fit into a corresponding one of the tab grooves of the surface features to axially and circumferentially lock the insert wherein an aft face of the aft section is engageable with the split retaining ring.

12. The method according to claim 11, wherein the assembling further comprises forming a forward exterior surface section which smoothly and continuously extends into the first annular wall.

13. The method according to claim 11, wherein:

each of the one or more inserts has one of two or more weights, and the method further comprises selecting each of the one or more inserts in accordance with the one of the two or more weights thereof.

* * * * *